US010378385B2

(12) United States Patent
Tesson et al.

(10) Patent No.: US 10,378,385 B2
(45) Date of Patent: Aug. 13, 2019

(54) TURBINE RING ASSEMBLY WITH RESILIENT RETENTION WHEN COLD

(71) Applicant: SAFRAN AIRCRAFT ENGINES, Paris (FR)

(72) Inventors: Thierry Tesson, Bordeaux (FR); Maxime Carlin, Bordeaux (FR); Jordan Caron, Le Haillan (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/063,019

(22) PCT Filed: Dec. 12, 2016

(86) PCT No.: PCT/FR2016/053343
§ 371 (c)(1),
(2) Date: Jun. 15, 2018

(87) PCT Pub. No.: WO2017/103411
PCT Pub. Date: Jun. 22, 2017

(65) Prior Publication Data

US 2018/0363506 A1 Dec. 20, 2018

(30) Foreign Application Priority Data

Dec. 18, 2015 (FR) ..... 15 62745

(51) Int. Cl.
*F01D 9/04* (2006.01)
*F01D 11/08* (2006.01)
(Continued)

(52) U.S. Cl.
CPC ..... *F01D 25/246* (2013.01); *F01D 9/04* (2013.01); *F01D 11/08* (2013.01); *F01D 25/005* (2013.01);
(Continued)

(58) Field of Classification Search
CPC ..... F01D 25/246; F01D 11/08; F01D 11/10; F01D 11/14; F01D 11/16; F01D 11/18;
(Continued)

(56) References Cited

U.S. PATENT DOCUMENTS 4,596,116 A * 6/1986 Mandet ..... F01D 11/08 415/173.2
5,993,150 A 11/1999 Liotta et al.
(Continued)

FOREIGN PATENT DOCUMENTS

FR 2580033 A1 * 10/1986 ..... F01D 25/246
WO WO 2006/136755 A2 12/2006
WO WO 2015/108658 A1 7/2015

OTHER PUBLICATIONS

International Preliminary Report on Patentability and the Written Opinion of the International Searching Authority as issued in International Patent Application No. PCT/FR2016/053343, dated Jun. 19, 2018.
(Continued)

*Primary Examiner* — Igor Kershteyn
*Assistant Examiner* — Topaz L. Elliot
(74) *Attorney, Agent, or Firm* — Pillsbury Winthrop Shaw Pittman LLP

(57) ABSTRACT

A turbine ring assembly includes ring sectors made of ceramic matrix composite material forming a turbine ring, and a ring support structure having first and second annular flanges, each ring sector having tabs. The first tab includes an annular groove in which there is received an annular projection of the first flange. The second tab of each ring sector is connected to the ring support structure by a resilient retention element. The second tab includes an opening in which there is received a portion of a retention element secured to the second annular flange of the ring support structure. The retention element is made of a material having
(Continued)

a coefficient of thermal expansion that is greater than the coefficient of thermal expansion of the ceramic matrix composite material of the ring sectors.

10 Claims, 6 Drawing Sheets

(51) Int. Cl.
*F01D 25/00* (2006.01)
*F01D 25/24* (2006.01)

(52) U.S. Cl.
CPC .... *F05D 2220/32* (2013.01); *F05D 2230/642* (2013.01); *F05D 2240/11* (2013.01); *F05D 2240/55* (2013.01); *F05D 2250/75* (2013.01); *F05D 2260/30* (2013.01); *F05D 2300/50212* (2013.01); *F05D 2300/6033* (2013.01)

(58) Field of Classification Search
CPC ..... F01D 11/20; F01D 11/22; F01D 11/24; F01D 9/04; F05D 2240/11
See application file for complete search history.

(56) References Cited

U.S. PATENT DOCUMENTS 7,665,958 B2 * 2/2010 Khanin ..... F01D 11/18 415/134
10,180,073 B2 * 1/2019 Tuertscher ..... F01D 9/041
2008/0087021 A1 * 4/2008 Radonovich ..... F01D 11/122 60/752
2009/0053050 A1 * 2/2009 Bruce ..... F01D 25/04 415/200
2009/0079139 A1 * 3/2009 Schiavo ..... F01D 9/04 277/595
2010/0104426 A1 * 4/2010 Keller ..... F01D 11/12 415/173.1
2012/0027572 A1 2/2012 Denece et al.
2013/0004306 A1 * 1/2013 Albers ..... F01D 25/246 415/200
2014/0308113 A1 * 10/2014 Westphal ..... F01D 11/00 415/134
2015/0016970 A1 * 1/2015 Smith ..... F01D 11/08 415/173.1
2016/0102572 A1 * 4/2016 O'Leary ..... F01D 11/12 415/173.1
2016/0169033 A1 * 6/2016 Weaver ..... F01D 25/005 415/200
2016/0201910 A1 * 7/2016 Chang ..... F01D 11/08 60/753
2016/0348523 A1 * 12/2016 Thomas ..... F01D 11/005
2018/0363507 A1 * 12/2018 Roussille ..... F01D 25/246
2018/0371948 A1 * 12/2018 Lepretre ..... F01D 25/246

OTHER PUBLICATIONS

International Search Report as issued in International Patent Application No. PCT/FR2016/053343, dated Jun. 27, 2017.

* cited by examiner

TURBINE RING ASSEMBLY WITH RESILIENT RETENTION WHEN COLD

CROSS REFERENCE TO RELATED APPLICATIONS

This application is the U.S. National Stage of PCT/FR2016/053343 filed Dec. 12, 2016, which in turn claims priority to French Application No. 1562745, filed Dec. 18, 2015. The contents of both applications are incorporated herein by reference in their entirety.

BACKGROUND OF THE INVENTION

The field of application of the invention is particularly that of gas turbine aeroengines. Nevertheless, the invention is applicable to other turbine engines, e.g. industrial turbines.

Ceramic matrix composite (CMC) materials are known for conserving their mechanical properties at high temperatures, which makes them suitable for constituting hot structural elements.

In gas turbine aeroengines, improving efficiency and reducing certain polluting emissions lead to a search for operation at ever-higher temperatures. For turbine ring assemblies made entirely out of metal, it is necessary to cool all of the elements of the assembly, and in particular the turbine ring, which is subjected to streams that are very hot, typically hotter than the temperature that can be withstood by the metal material. Such cooling has a significant impact on the performance of the engine, since the cooling stream used is taken from the main stream through the engine. In addition, the use of metal for the turbine ring limits possibilities for increasing temperature within the turbine, even though that would improve the performance of aeroengines.

Furthermore, a metal turbine ring assembly deforms under the effect of hot streams, thereby changing clearances associated with the flow passage, and consequently modifying the performance of the turbine.

That is why proposals have already been made to use CMC for various hot portions of engines, particularly since CMCs present the additional advantage of density that is lower than that of the refractory metals conventionally used.

Thus, making turbine ring sectors as single pieces of CMC is described in particular in Document US 2012/0027572. The ring sectors have an annular base with its inner face defining the inside face of the turbine ring and an outer face from which there extend two tab-forming portions having their ends engaged in housings in a metal ring support structure.

The use of ring sectors made of CMC makes it possible to reduce significantly the amount of ventilation needed for cooling the turbine ring. Nevertheless, keeping or retaining ring sectors in position remains a problem in particular in the face of differential expansion, as can occur between a metal support structure and CMC ring sectors. In addition, another problem lies in controlling the shape of the passage both when cold and when hot without generating excessive stresses on the ring sectors.

OBJECT AND SUMMARY OF THE INVENTION

The invention seeks to avoid such drawbacks and for this purpose it provides a turbine ring assembly comprising a plurality of ring sectors made of ceramic matrix composite material forming a turbine ring and a ring support structure having first and second annular flanges, each ring sector having an annular base forming portion having an inner face defining the inside face of the turbine ring and an outer face from which there extend first and second tabs, the tabs of each ring sector being retained between the two annular flanges of the ring support structure; the turbine ring assembly being characterized in that the first tab of each ring sector includes an annular groove in its face facing the first annular flange of the ring support structure, the first annular flange of the ring support structure including an annular projection on its face facing the first tab of each ring sector, the annular projection of the first flange being received in the annular groove of the first tab of each ring sector, clearance being present when cold between the annular projection and the annular groove; in that at least the second tab of each ring sector is connected to the ring support structure by at least one resilient retention element; and in that the second tab of each ring sector includes at least one opening in which there is received a portion of a retention element secured to the second annular flange of the ring support structure, clearance being present when cold between the opening in the second tab and the portion of the retention element present in said opening, said retention element being made of a material having a coefficient of thermal expansion that is greater than the coefficient of thermal expansion of the ceramic matrix composite material of the ring sectors.

In the ring assembly of the invention, the ring sectors are retained when cold by resilient retention means that enable the ring sectors to be mounted without prestress. The resilient retention means of the ring sectors no longer ensure retention when hot because they expand. When hot, the retention force is taken up by the expansion of the annular projection of the first flange and of the retention element(s), which expansion does not lead to stress on the annular sectors because firstly of the presence of clearance when cold between the annular projection of the first flange and the annular groove of the first tab of each ring sector, and secondly because of the clearance between the retention element(s) and the opening(s) in the second tab.

In an embodiment of the ring assembly of the invention, each ring sector is Pi-shaped in axial section, the first and second tabs extending from the outer face of the annular base forming portion, the resilient retention means comprising a base fastened to the ring support structure and from which first and second arms extend, each arm including a C-clip type resilient attachment portion at its free end, the free end of the first tab of each ring sector being retained by the resilient attachment portion of the first arm, while the free end of the second tab of each ring sector is retained by the resilient attachment portion of the second arm of the resilient retention means.

The use of C-clip type resilient attachment portions enables assembly to be performed cold with little stress. Contact between the ring sectors and the ring support structure is uniform, thereby enabling forces to be well distributed.

According to a particular characteristic of the ring assembly of the invention, the first tab of each ring sector includes an outer groove and an inner groove co-operating with the C-clip type resilient attachment portion of the first arm of the resilient retention means, the second tab of each ring sector including an outer groove and an inner groove co-operating with the C-clip type resilient attachment portion of the second arm of the resilient retention means.

The inner and outer grooves of the first and second tabs of each ring sector may present a radius of curvature similar to the radius of curvature of the C-clip type resilient attachment portions of the first and second arms of the resilient retention means. They may also be rectilinear in shape, the C-clip type resilient attachment portions of the first and second arms of the resilient retention means then extending in a rectilinear direction.

In an another embodiment the ring assembly of the invention, each ring sector is Pi-shaped in axial section, the first and second tabs extending from the outer face of the annular base forming portion, the resilient retention means comprising a base fastened to the ring support structure and from which there extend first and second arms together forming a C-clip type resilient attachment portion, the free end of the first tab of each ring sector being retained by the first arm, while the free end of the second tab of each ring sector is retained by the second arm of the resilient retention means.

The use of a C-clip resilient attachment portion makes it possible to perform assembly when cold with little stress. Contact between the ring sectors and the ring support structure is uniform, thereby enabling forces to be well distributed.

According to a particular characteristic of the ring assembly of the invention, the first tab of each ring sector includes an outer groove co-operating with the free end of the first arm of the resilient retention means, the second tab of each ring sector including an outer groove co-operating with the free end of the second arm of the resilient retention means.

The outer grooves of the first and second tabs of each ring sector may be rectilinear in shape, the free ends of the first and second arms of the resilient retention means extending in a rectilinear direction.

In yet another embodiment of the ring assembly of the invention, each ring sector presents a K-shape in axial section, the first and second tabs extending from the outer face of the annular base forming portion, the first tab having an annular groove at its first end in which there is received the annular projection of the first annular flange, the second tab of each ring sector being connected to the second flange via one or more resilient retention elements.

According to a particular characteristic of the ring assembly of the invention, the second tab of each ring sector is connected to the second annular flange of the ring support structure by one or more clip elements.

BRIEF DESCRIPTION OF THE DRAWINGS

The invention can be better understood on reading the following description given by way of non-limiting indication and with reference to the accompanying drawings, in which.

DETAILED DESCRIPTION OF EMBODIMENTS

Figure 1:
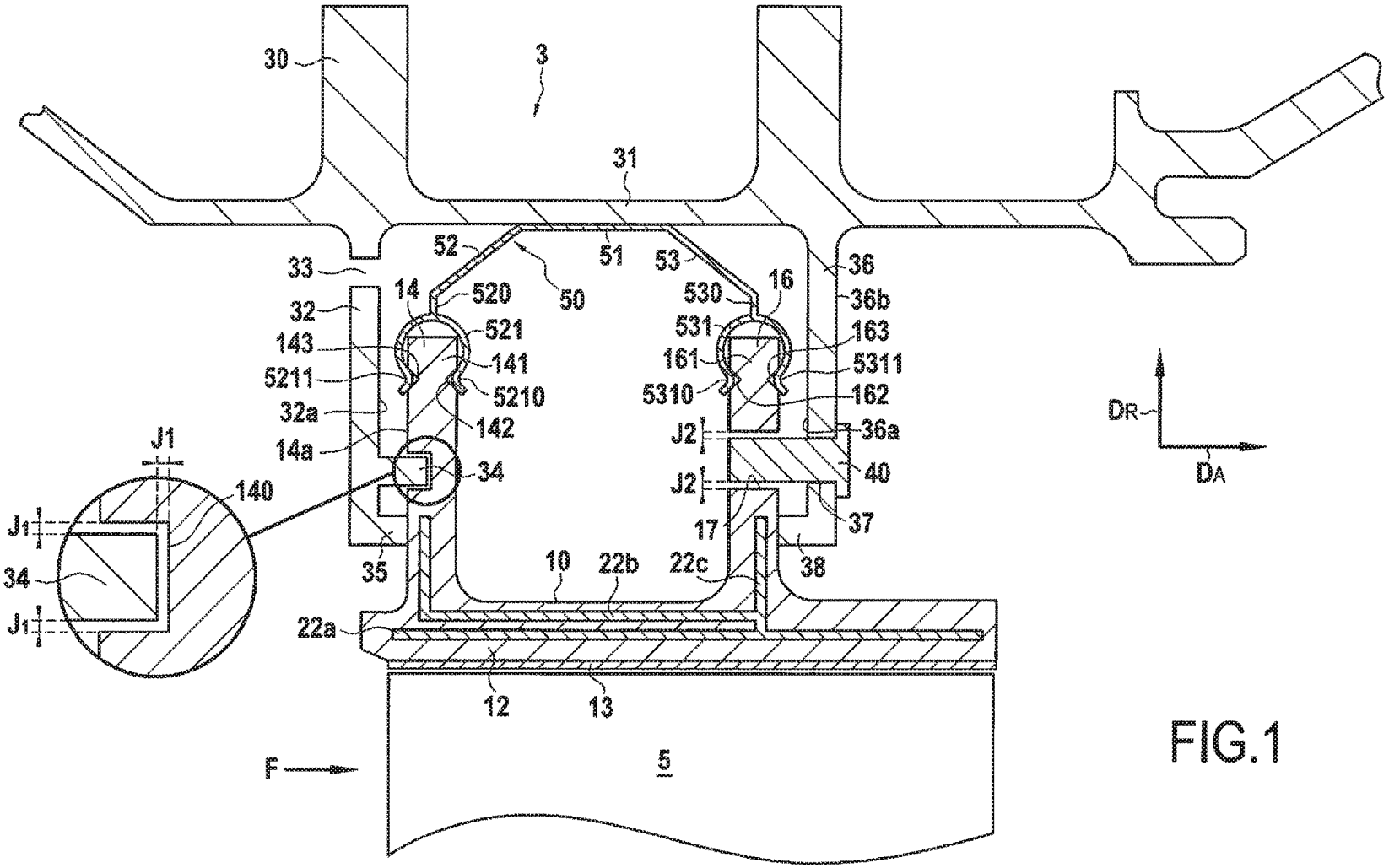
FIG. 1 is a section showing an embodiment of a turbine ring assembly of the invention.

FIG. 1 shows a high pressure turbine ring assembly comprising a turbine ring 1 made of ceramic matrix composite (CMC) material and a metal ring support structure 3. The turbine ring 1 surrounds a set of rotary blades 5. The turbine ring 1 is made up of a plurality of ring sectors 10, FIG. 1 being a view in radial section. Arrow DA shows the axial direction relative to the turbine ring 1, while arrow DR shows the radial direction relative to the turbine ring 1.

Each ring sector 10 is of cross-section that is substantially in the shape of an upside-down Greek letter Pi, or "π", with an annular base 12 having its inner face coated in a layer 13 of abradable material that defines the flow passage for the gas stream through the turbine. Upstream and downstream tabs 14 and 16 extend from the outer face of the annular base 12 in the radial direction DR. The terms "upstream" and "downstream" are used herein relative to the flow direction of the gas stream through the turbine (arrow F).

The ring support structure 3, which is secured to a turbine casing 30, comprises a resilient retention element or means 50 comprising a base 51 fastened on the inner face of the shroud 31 of the turbine casing 30, and first and second arms 52 and 53 extending from the base 51 respectively upstream and downstream. The base 51 may be fastened to the inside face of the shroud 31 of the turbine casing 30, in particular by welding, by pegging, by riveting, or by clamping using a nut-and-bolt type fastener member, orifices being pierced in the base 51 and the shroud 31 for passing such connection or fastener elements.

The first arm 52 has a C-clip type resilient attachment portion 521 at its free end 520, which portion presents a radius of curvature. The resilient attachment portion 521 retains the free end 141 of the upstream tab 14 of each ring sector 10. The free end 141 of the upstream tab 14 has inner and outer grooves 142 and 143 formed on either side of the tab 14 for co-operating with the resilient attachment portion 521, the grooves 142 and 143 in this example presenting a radius of curvature similar to the radius of curvature of the resilient attachment portion 521. Likewise, the second arm 53 has a C-clip type resilient attachment portion 531 at its free end 530, this portion presenting a radius of curvature, and serving to retain the free end 161 of the downstream tab 16 of each ring sector 10. The free end 161 of the downstream tab 16 has inner and outer grooves 162 and 163 formed in both sides of the tab 16 and co-operating with the resilient attachment portion 531, the grooves 162 and 163 in this example presenting a radius of curvature similar to the radius of the curvature of the resilient attachment portion 531.

The resilient retention element 50 may be made of a metal material such as a Waspaloy®, Inconel 718, or AM1 alloy. It is preferably made as a plurality of annular sectors so as to make it easier to fasten to the casing 30. The resilient retention element 50 serves to retain the ring sectors 10 on the ring support structure 3 when cold. The term "cold" is used in the present invention to mean the temperature at which the ring assembly is to be found when the turbine is not in operation, i.e. an ambient temperature, which may for example be about 25° C.

The ring support structure 3 has an upstream annular radial flange 32 with a first projection 34 on its inner face **32*a* facing the upstream tabs 14 of the ring sectors 10, the projection 34 being received in an annular groove 140 present in the outer face 14*a* of the upstream tabs 14. When cold, clearance J1 is present between the first projection 34 and the annular groove 140. The expansion of the first projection 34 in the annular groove 140 contributes to retaining ring sectors 10 on the ring support structure 3** when hot. The term "hot" is used herein to mean the temperatures to which the ring assembly is subjected while the turbine is in operation, which temperatures may lie in the range 600° C. to 900° C.

The upstream annular radial flange 32 also has a second projection 35 facing the outer face 14*a* of the upstream tabs 14, the second projection 35 extending from the inner face 32*a* of the upstream radial flange 32 over a distance that is shorter than that of the first projection 34.

On the downstream side, the ring support structure has a downstream annular radial flange 36 with a projection 38 on its inner face 36*a* facing the downstream tabs 16 of the ring sectors 10.

Furthermore, in the presently-described example, the ring sectors 10 are also retained by retention elements, specifically in the form of keepers 40. The keepers 40 are engaged both in the downstream annular flange 36 of the ring support structure 3 and in the downstream tabs 16 of the ring sectors 10. For this purpose, each keeper 40 passes through a respective orifice 37 formed in the downstream annular radial flange 36 and a respective orifice 17 formed in each downstream tab 16, the orifices 37 and 17 being put into alignment when mounting the ring sectors 10 on the ring support structure 3. The keepers 40 are made of a material having a coefficient of thermal expansion that is greater than the coefficient of thermal expansion of the ceramic matrix composite material of the ring sectors 10. By way of example, the keepers 40 may be made of metal material. Clearance J2 is present when cold between the keepers 40 and the orifices 17 present in each downstream tab 16. The expansion of the keepers 40 in the orifices 17 contributes to retaining the ring sectors 10 on the ring support structure 3 when hot.

In addition, sealing is provided between sectors by sealing tongues received in grooves that face each other in facing edges of two neighboring ring sectors. A tongue 22*a* extends over almost the entire length of the annular base 12 in its middle portion. Another tongue 22*b* extends along the tab 14 and over a portion of the annular base 12. Another tongue 22*c* extends along the tab 16. At one end, the tongue 22*c* comes into abutment against the tongue 22*a* and against the tongue 22*b*. By way of example, the tongues 22*a*, 22*b*, and 22*c* are made of metal and are mounted with clearance when cold in their housings so as to provide the sealing function at the temperatures that are encountered in operation.

In conventional manner, ventilation orifices 33 formed in the flange 32 allow cooling air to be delivered from the outside of the turbine ring 10.

There follows a description of how a turbine ring assembly corresponding to that shown in FIG. 1 is made.

Each above-described ring sector 10 is made of ceramic matrix composite (CMC) material by forming a fiber preform of shape close to that of the ring sector and by densifying the ring sector with a ceramic matrix.

In order to make the fiber preform, it is possible to use yarns made of ceramic fibers, e.g. yarns made of SiC fibers such as those sold by the Japanese supplier Nippon Carbon under the name "Nicalon", or yarns made of carbon fibers.

The fiber preform is advantageously made by three-dimensional weaving or by multilayer weaving, while leaving zones of non-interlinking that enable the portions of the preforms that correspond to the tabs 14 and 16 to be moved away from the sectors 10.

The weaving may be of the interlock type, as shown. Other three-dimensional or multilayer weaves could be used, such as for example multi-plain or multi-satin weaves. Reference may be made to Document WO 2006/136755.

After weaving, the blank may be shaped in order to obtain a ring sector preform that is then consolidated and then densified with a ceramic matrix, which densification may be performed in particular by chemical vapor infiltration (CVI), as is well known.

A detailed example of fabricating CMC ring sectors is described in particular in Document US 2012/0027572.

The ring support structure 3 is made of a metal material such as a Waspaloy®, Inconel 718, or AM1 alloy.

Figure 2:
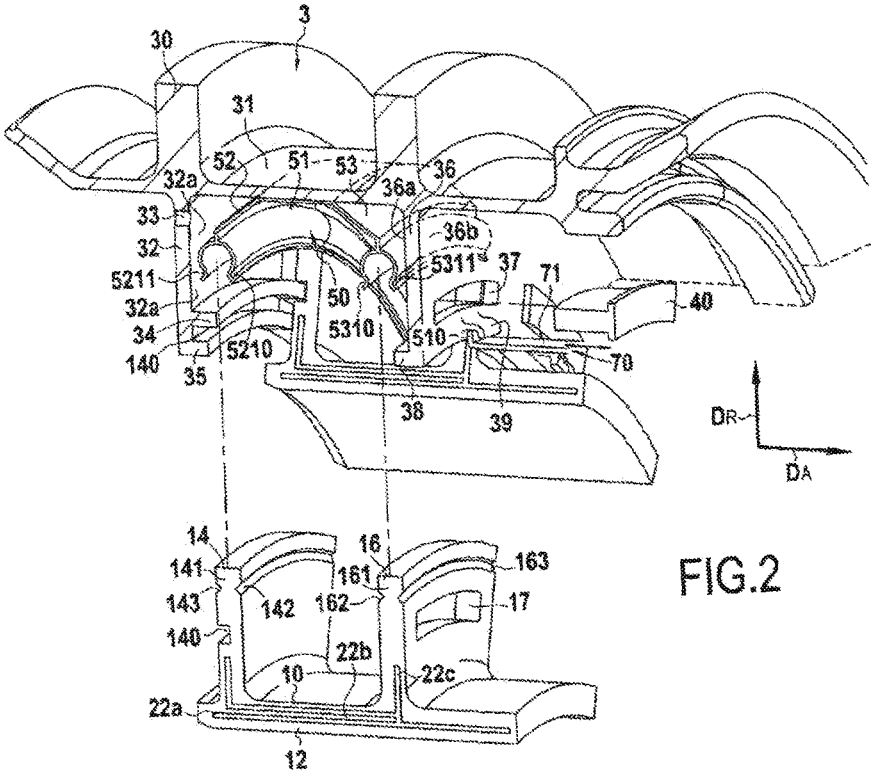
FIG. 2 is a diagram showing a ring sector being mounted in the ring support structure of the FIG. 1 ring assembly.

Assembly of the turbine ring assembly then continues by mounting ring sectors 10 on the ring support structure 3. In the example described, the ring support structure has at least one flange that is elastically deformable in the axial direction DA of the ring, in this example the downstream annular radial flange 36. While a ring sector 10 is being mounted, the downstream annular radial flange 36 is pulled in the direction DA as shown in FIG. 2 so as to increase the spacing between the flanges 32 and 36 and enable the first projection 34 present on the flange 32 to be inserted in the groove 140 present in the tab 14 without running the risk of damaging the ring sector 10. In order to make it easier to move the downstream annular radial flange 36 away, it includes a plurality of hooks 39 that are distributed over its face 36*b* that faces away from the face 36*a* of the flange 36 facing the downstream tabs 16 of the ring sectors 10. The traction exerted on the elastically deformable flange 36 in the axial direction DA of the ring is applied in this example by means of a tool 70 having at least one arm 71 with an end including a hook 510 that is engaged in a hook 39 present on the outer face 36*b* of the flange 36. The number of hooks 39 distributed over the face 36*b* of the flange 36 is defined as a function of the number of traction points that it is desired to have on the flange 36. This number depends mainly on the resilient nature of the flange. Other shapes and arrangements for the means that enable traction to be exerted in the axial direction DA on one of the flanges of the ring support structure may naturally be envisaged in the ambit of the present invention.

Once the annular flange 36 has been moved away in the direction DA, the free ends 141 and 161 of the tabs 14 and 16 are engaged respectively in the resilient attachment portions 521 and 531 of the resilient retention element 50, firstly until the grooves 142 and 143 of the tab 14 co-operate respectively with the curved ends 5210 and 5211 of the resilient attachment portion 521, and secondly until the grooves 162 and 163 of the tab 16 co-operate respectively with the curved ends 5310 and 5311 of the resilient attachment portion 531. Once the projection 34 of the flange 32 has been inserted in the groove 140 of the tab 14, and the curved ends 5210, 5211, 5310, and 5311 have been received in the grooves 142, 143, 162, and 163, and the tabs 14 and 16 have been positioned so as to put the orifices 17 and 37 into alignment, the flange 36 is released. A keeper 40 is then engaged in the aligned orifices 37 and 17 formed respectively in the downstream annular radial flange 36 and in the downstream tab 16. Each ring sector tab 14 or 16 may include one or more orifices for passing one or more keepers. The keepers 40 are tight fits in the orifices 37 in the downstream annular radial flange 36, providing assemblies known as H6-P6 fits or other tight-fit assemblies enabling these elements to be held together when cold. The keepers 40 may be replaced by pegs or any other equivalent element.

When cold, the ring sectors 10 are retained by the resilient retention element 50. When hot, the expansion of the resilient retention element 50 means that it can no longer ensure that the ring sectors are retained by the attachment portions 521 and 531. Retention when hot is provided both by the expansion of the projection 34 in the groove 140 of the tab 14, thereby absorbing or eliminating the clearance J1, and by the expansion of the keeper 40 in the orifice 17 of the tab 16, thereby absorbing or eliminating the clearance J2.

Figure 3:
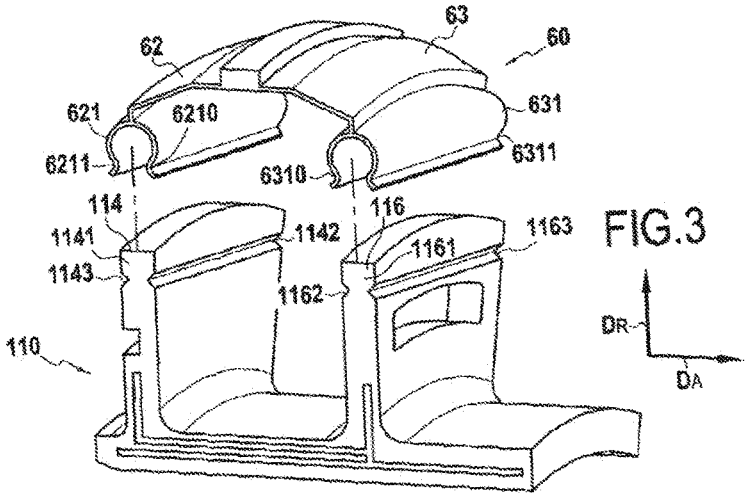
FIG. 3 is a diagrammatic perspective view showing a variant embodiment of the FIG. 1 ring assembly.

FIG. 3 shows a variant embodiment of the high pressure turbine ring assembly that differs from the high pressure turbine ring assembly described above with reference to FIGS. 1 and 2 in that the inner and outer grooves 1142 and 1143 present at the end 1141 of the tab 114 of each ring sector 110 and the inner and outer grooves 1162 and 1163 present at the end 1161 of the tab 116 of each ring sector 110 are rectilinear in shape, and in that the curved ends 6210 and 6211 of the resilient attachment portion 621 present at the end of the first arm 62 of each resilient retention element 60 and the curved ends 6310 and 6311 of the resilient attachment portion 631 present at the end of the second arm 63 of each resilient attachment element 60 extend in a rectilinear direction. This makes it possible in particular to simplify the machining of the grooves in the tabs of the ring sectors. Under such circumstances, the resilient retention element 60 is made up of a plurality of segments. The other portions of the high pressure turbine ring assembly are identical to those described above with reference to the ring assembly shown in FIGS. 1 and 2.

Figure 4:
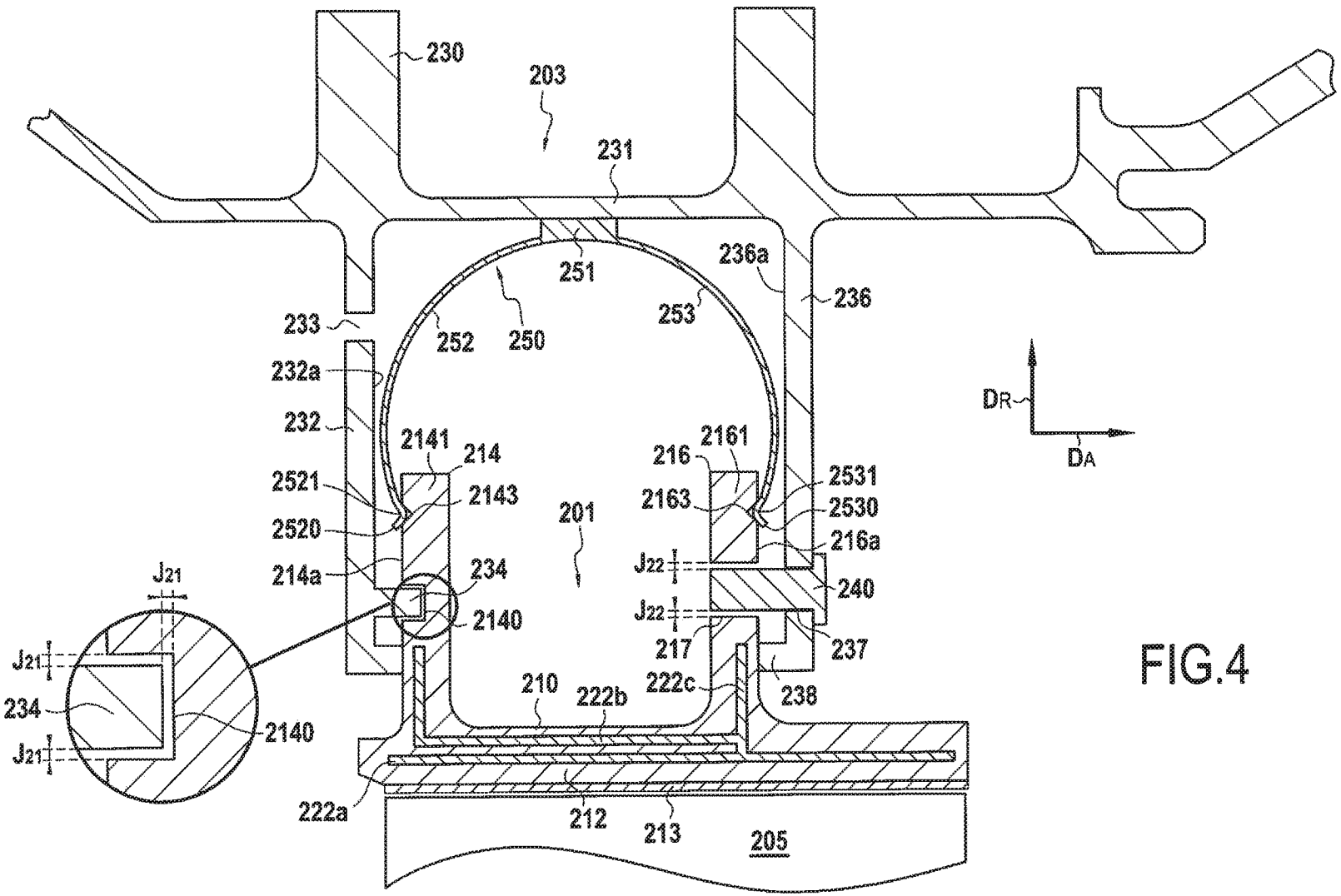
FIG. 4 is a section view showing another embodiment of a turbine ring assembly of the invention.

FIG. 4 shows a high pressure turbine ring assembly in another embodiment that differs from the ring assembly described above with reference to FIGS. 1 and 2 in that it uses different resilient retention elements or means. Like the above-described ring assembly, the FIG. 4 ring assembly comprises a turbine ring 201 made of ceramic matrix composite (CMC) material and a metal ring support structure 203. The turbine ring 201 is made up of a plurality of ring sectors 210 and surrounds a set of rotary blades 205. Each ring sector 210 presents a section that is substantially in the shape of an upside-down Greek letter Pi, or "π", with an annular base 212 having its inner face coated in a layer 213 of abradable material, and upstream and downstream tabs 214 and 216 extending from the outer face of the annular base 212 in the radial direction DR.

The ring support structure 203, which is secured to a turbine casing 230, has a resilient retention element or means 250 comprising a base 251 fastened to the inner face of the shroud 231 of the turbine casing 230, and first and second arms 252 and 253 extending from the base 251 respectively upstream and downstream. With these two arms 252 and 253, the resilient retention element 250 forms a C-clip type resilient attachment serving to retain the ring sectors 210 on the ring support structure 203 when cold. The first arm 252 has a curved attachment portion 2521 at its free end 2520, which attachment portion extends in a rectilinear direction in this example. The curved attachment portion 2521 retains the free end 2141 of the upstream tab 214 of each ring sector 210. The free end 2141 of the upstream tab 214 includes an outer groove 2143 arranged in the outer face 214*a* of the tab 214 and co-operating with the curved attachment portion 2521, the groove 2143 in this example being rectilinear in shape. Likewise, the second arm 253 has a curved attachment portion 2531 at its free end 2530, which attachment portion extends in a rectilinear direction and retains the free end 2161 of the downstream tab 216 of each ring sector 210. The free end 2161 of the downstream tab 216 includes an outer groove 2163 arranged in the outer face 216*a* of the tab 216 and co-operating with the curved attachment portion 2531, the groove 2163 in this example being rectilinear in shape.

The resilient retention element 250 may be made of a metal material such as a Waspaloy®, Inconel 718, or AM1 alloy. It is preferably made up as a plurality of annular sectors in order to make it easier to fasten to the casing 230. The resilient retention element 250 serves to retain the ring sectors 210 on the ring support structure 203 when cold.

In the same manner as described above for the ring assembly of FIGS. 1 and 2, the ring support structure 203 has an upstream annular radial flange 232 having a first projection 234 on its inner face 232*a* facing the upstream tabs 214 of the ring sectors 210, the projection 234 being received in an annular groove 2140 present in the outer faces 214*a* of the upstream tabs 214. Clearance J21 is present when cold between the first projection 234 and the annular groove 2140. The expansion of the first projection 234 in the annular grooves 2140 contributes to retaining the ring sectors 210 on the ring support structure 203 when hot. The upstream annular radial flange 232 also has a second projection 235 facing the outer faces 214*a* of the upstream tabs 214, the second projection 235 extending from the inner face 232*a* of the upstream radial flange 232 over a distance that is less than that of the first projection 234. On the downstream side, the ring support structure has a downstream annular radial flange 236 having a projection 238 on its inner face 236*a* facing the downstream tabs 216 of the ring sectors 210.

Furthermore, in the presently-described example, the ring sectors 210 are also retained by the retention elements, in this example in the form of keepers 240. The keepers 240 are engaged both in the downstream annular flange 236 of the ring support structure 203 and in the downstream tabs 216 of the ring sectors 210. For this purpose, each keeper 240 passes respectively through a respective orifice 237 formed in the downstream annular radial flange 236 and a respective orifice 217 formed in each downstream tab 216. The keepers 240 are made of a material having a coefficient of thermal expansion that is greater than the coefficient of thermal expansion of the ceramic matrix composite material of the ring sectors 210. The keepers 240 may for example be made of metal material. Clearance J22 is present when cold between the keepers 240 and the orifices 217 present in each downstream tab 216. The expansion of the keepers 240 in the orifices 217 contributes to retaining the ring sectors 210 on the ring support structure 203 when hot.

In addition, sealing between sectors is provided by sealing tongues 222*a*, 222*b*, and 222*c* as described above. In conventional manner, ventilation orifices 233 formed in the flange 232 serve to bring cooling air from the outside of the turbine ring 201.

Each ring sector 210 is made of ceramic matrix composite (CMC) material by forming a fiber preform of shape close to the shape of the ring sector and by densifying the ring sector with a ceramic matrix. The ring support structure 203 is made of a metal material such as a Waspaloy®, Inconel 718, or AM1 alloy.

Figure 5:
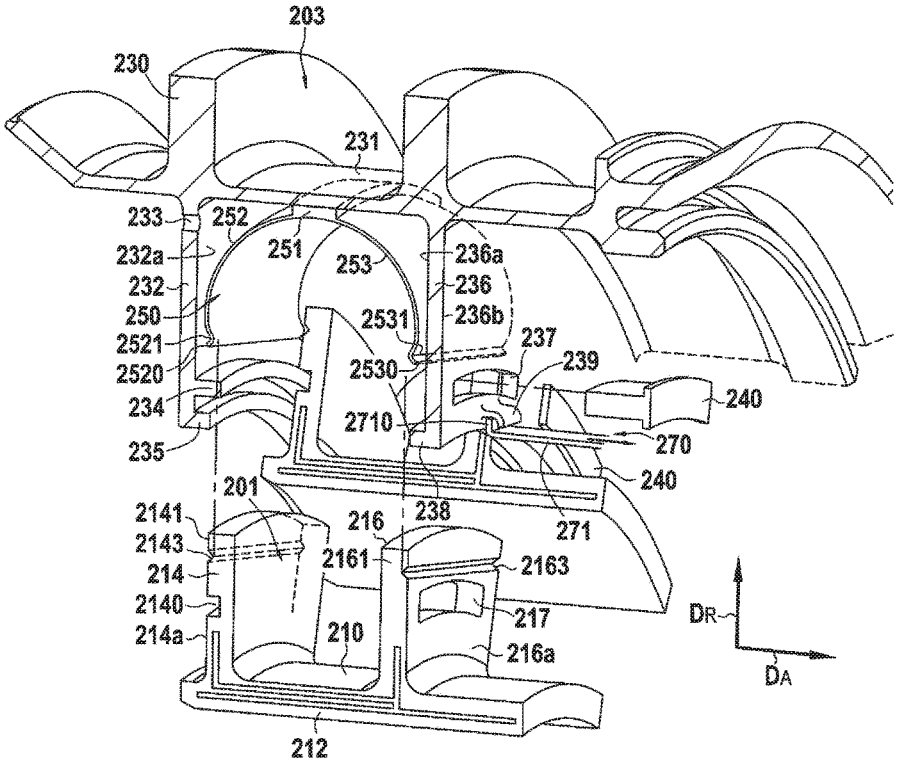
FIG. 5 is a diagram showing a ring sector being mounted in the ring support structure of the FIG. 4 ring assembly.

When assembling a ring sector 210, the downstream annular radial flange 236 is pulled in the direction DA as shown in FIG. 5 so as to enable the first projection 234 present on the flange 232 to be inserted in the groove 2140 present in the tab 214 without running the risk of damaging the ring sector 210. In order to facilitate moving the downstream annular radial flange 236 away by traction, it includes a plurality of hooks 239 distributed over its face 236*b*, which face is opposite from the face 236*a* of the flange 236 that faces the downstream tabs 216 of the ring sectors 210. The traction in the axial direction DA of the ring exerted on the elastically deformable flange 236 is performed in this example by means of a tool 270 having at least one arm 271 with its end including a hook 2710 that is engaged in a hook 239 present on the outer face 236*a* of the flange 236.

Once the annular flange 236 has been moved away in the direction DA, the free ends 2141 and 2161 of the tabs 214 and 216 are engaged between the ends 2520 and 2530 of the resilient retention element 250 until the groove 2143 of the tab 214 and the groove 2163 of the tab 216 co-operate respectively with the curved attachment portions 2521 and 2531 of the resilient retention element 250. Once the projection 234 of the flange 232 is inserted in the groove 2140 of the tab 214, and the curved attachment portions 2521 and 2531 are positioned in the grooves 2143 and 2163, and said tabs 214 and 216 are positioned so as to put the orifices 217 and 237 in alignment, the flange 236 is released. A keeper 240 is then engaged in the aligned orifices 237 and 217 formed respectively in the downstream annular radial flange 236 and in the downstream tab 216. Each tab 214 or 216 of the ring sector may include one or more orifices for passing one or more keepers. The keepers 240 are tight fits in the orifices 237 of the downstream annular radial flange 236 providing assemblies known as H6-P6 fits or other tight assemblies enabling these elements to be held together when cold. The keepers 240 may be replaced by pegs or any other equivalent element.

When cold, the ring sectors 210 are retained by the resilient retention element 250. When hot, the expansion of the resilient retention element 250 means that it can no longer ensure that the ring sectors are retained by the curved attachment portions 2521 and 2531. Retention when hot is provided both by the projection 234 expanding in the groove 2140 of the tab 214, thereby absorbing or eliminating the clearance J21, and by the expansion of the keeper 240 in the orifice 217 in the tab 16, thereby absorbing or eliminating the clearance J22.

Figure 6:
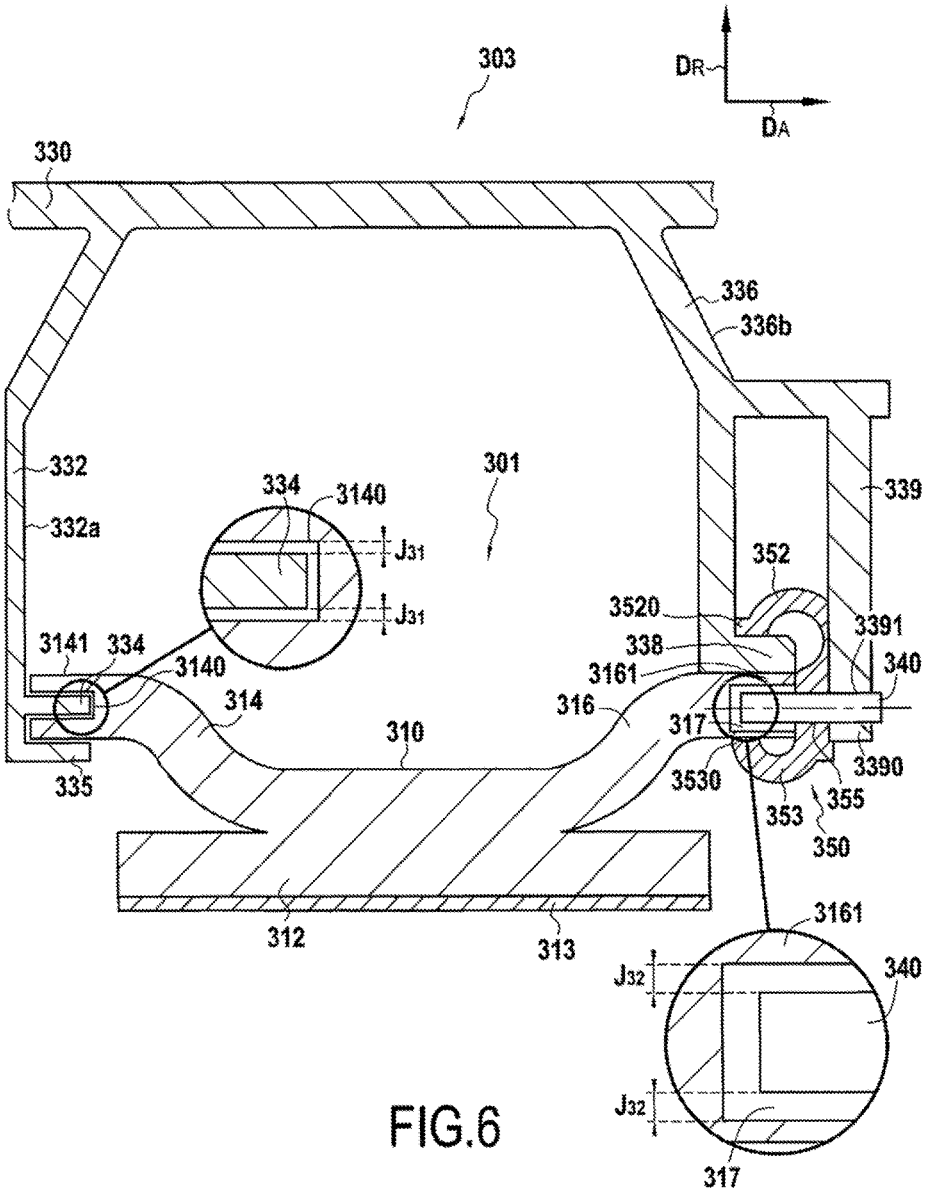
FIG. 6 is a section view showing another embodiment of a turbine ring assembly of the invention.

FIG. 6 shows a high pressure turbine ring assembly in another embodiment. Like the ring assemblies described above, the FIG. 6 ring assembly comprises a turbine ring 301 made of ceramic matrix composite (CMC) material and a metal ring support structure 303 secured to a turbine casing 330. The turbine ring 301 is made up of a plurality of ring sectors 310 and surrounds a set of rotary blades (not shown in FIG. 6). Each ring sector 310 is in the shape of the letter K with an annular base 312 having its inner face coated in a layer 313 of abradable material to define the passage for the gas stream flow through the turbine. A first tab 314 and a second tab 316, both substantially in the shape of the letter S, extend from the outer face of the annular base 312.

The ring support structure 303 has an upstream annular radial flange 332 with a first projection 334 on its inner face 332*a* facing the upstream tabs 314 of the ring sectors 310, the projection 334 being received in annular grooves 3140 present in the ends 3141 of the upstream tabs 314. Clearance J31 is present when cold between the first projection 334 and the annular groove 3140. The expansion of the first projection 334 in the annular grooves 3140 contributes when hot to retain the ring sectors 310 on the ring support structure 303. The upstream annular radial flange 332 also has a second projection 335 that projects under the ends 3141 of the upstream tabs 314.

On the downstream side, the ring support structure has a downstream annular radial flange 336 with a projection 338 on its outer face 336*b*. The annular radial flange 336 also has arms 339, there being two arms per ring sector in this element, which arms extend radially beside the outer surface of the flange 336. Each arm 339 includes an orifice 3391 at its free end 3390.

The ring assembly also has C-clip type resilient retention elements or means 350, each having a first resilient attachment portion 352 and a second resilient attachment portion 353. The resilient retention elements 350 serve, when cold, to retain the ends 3161 of the downstream tabs 316 of the ring sectors 310 against the projection 338, stress being exerted on its two portions respectively by the end 3520 of the first resilient attachment portion 352 and the end 3530 of the second resilient attachment portion 353 of each resilient retention element 350. The resilient retention element 350 may be made of a metal material such as a Waspaloy®, Inconel 718, or AM1 alloy.

Furthermore, in the presently-described example, the ring sectors 310 are also retained by retention elements, in this example in the form of pegs 340. The pegs 340 are engaged both in the arms 339 of the downstream annular flange 336 of the ring support structure 303 in the resilient retention elements 350, and in the downstream tabs 316 of the ring sectors 310. For this purpose, each peg 340 passes through a respective orifice 3391 formed in each arm 339 present on the downstream annular radial flange 3236, a respective orifice 355 formed in each resilient retention element 350, and a respective orifice 317 formed in each tab 316. The pegs 340 are made of a material having a coefficient of thermal expansion greater than the coefficient of thermal expansion of the ceramic matrix composite material of the ring sectors 310. By way of example, the pegs 340 may be made of a metal material. Clearance J32 is present when cold between the pegs 340 and the orifices 317 present in each downstream tab 216. When hot, the expansion of the pegs 340 in the orifices 317 contributes to retaining the ring sectors 310 on the ring support structure 303.

Each ring sector 310 is made of ceramic matrix composite (CMC) material by forming a fiber preform of shape close to that of the ring sector and by densifying the ring sector with a ceramic matrix. The ring support structure 303 may be made of a metal material such as a Waspaloy®, Inconel 718, or AM1 alloy.

Figure 7:
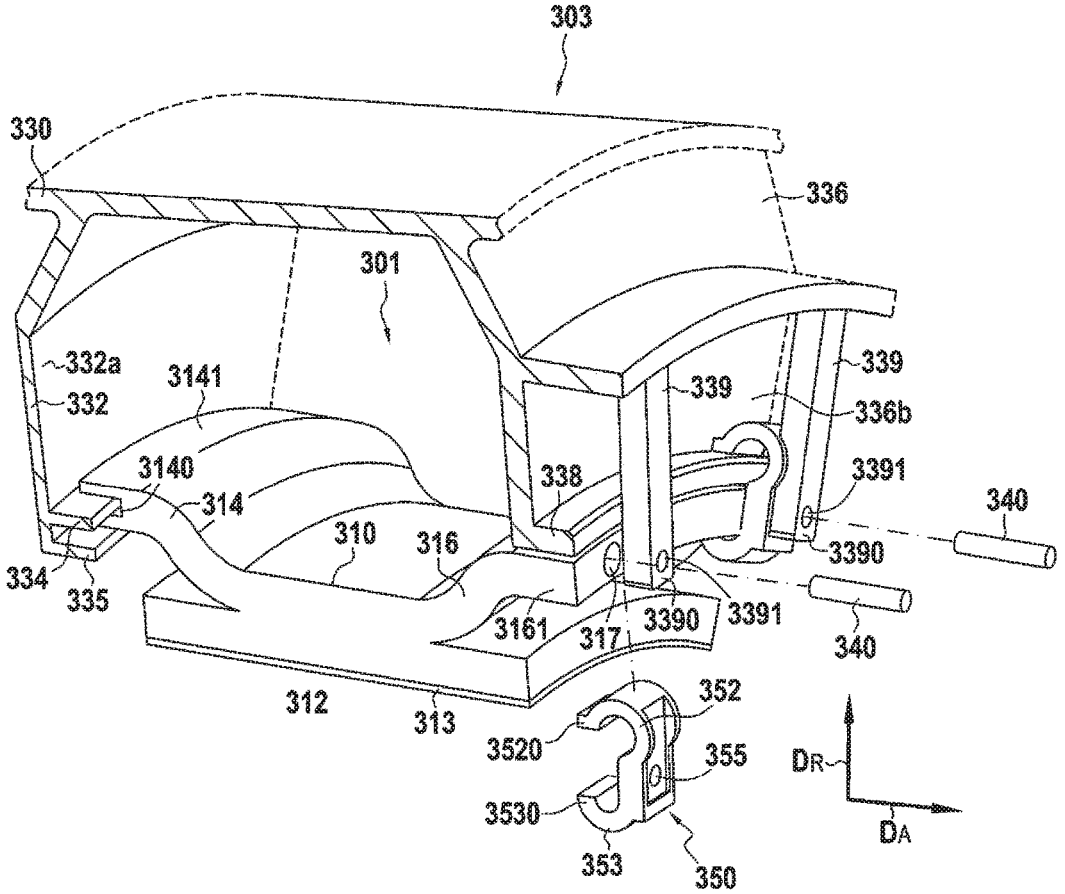
FIG. 7 is a diagram shown a ring sector being mounted in the ring support structure of the FIG. 6 ring assembly.

During assembly of the ring sector 310, as shown in FIG. 7, the first projection 334 present on the flange 332 is engaged in the groove 3140 present in the tab 314. The end 3161 of the tab 316 of each ring sector 310 is pressed against the projection 338 present at the end of the annular flange 336. Once the projection 334 is inserted in the groove 3140 and the end 3161 is pressed against the projection 338, the resilient attachment elements 250 are positioned between the end 3161 and the projection 338, the end 3520 of the first resilient attachment portion 352 being in contact with the projection 338, and the end 3530 of the second resilient attachment portion 353 of each resilient retention element 350 being in contact with the end 3161 of the tab 316. When cold, the resilient elements 350 serve to retain the end 3161 of the tab 316 of each ring sector 310 against the projection 338 of the annular flange 336.

A peg 340 is then engaged in each aligned series of orifices 3391, 355, and 317 formed respectively in each arm 339 present on the downstream annular radial flange 336, in a resilient retention element 350, and in the tab 316. The pegs 340 are tight fits in the orifices 3391 in each arm 339 being assembled by H6-P6 fits or other tight-fit assemblies that enable these elements to be held together when cold. The pegs 340 may be replaced by keepers or any other equivalent element.

When cold, the ring sectors 310 are retained by the resilient retention element 350. When hot, the expansion of the resilient retention element 350 means that it no longer serves to retain the ring sectors by the resilient attachment portions 352 and 353. Retention when hot is provided both by the expansion of the projection 334 in the groove 3140 of the tab 314, which absorbs or eliminates the clearance J31, and by the expansion of the pegs 340 in the orifices 317 of the tabs 316, thereby absorbing or eliminating the clearance J32.

The turbine ring assembly of FIGS. 6 and 7 is described with ring sectors presenting a section that is K-shaped. Nevertheless, this embodiment applies equally well to ring sectors having a section that is substantially in the shape of an upside-down Greek letter π, like those shown in FIGS. 1 to 5. Likewise, the embodiments of the turbine ring assembly described with reference to FIGS. 1 to 5 are equally applicable to ring sectors presenting a section that is K-shaped.

The invention claimed is:

1. A turbine ring assembly comprising a plurality of ring sectors made of ceramic matrix composite material forming a turbine ring and a ring support structure having first and second annular flanges, each ring sector having an annular base forming portion having an inner face defining the inside face of the turbine ring and an outer face from which there extend first and second tabs, the tabs of each ring sector being retained between the first and second annular flanges of the ring support structure;

wherein the first tab of each ring sector includes an annular groove in its face facing the first annular flange of the ring support structure, the first annular flange of the ring support structure including an annular projection on its face facing the first tab of each ring sector, the annular projection of the first annular flange being received in the annular groove of the first tab of each ring sector, clearance being present when cold between the annular projection and the annular groove;

wherein at least the second tab of each ring sector is connected to the ring support structure by at least one first resilient retention element; and wherein the second tab of each ring sector includes at least one opening in which there is received a portion of a second retention element secured to the second annular flange of the ring support structure, clearance being present when cold between the opening in the second tab and the portion of the second retention element present in said opening, said second retention element being made of a material having a coefficient of thermal expansion that is greater than a coefficient of thermal expansion of the ceramic matrix composite material of the ring sectors.

2. The assembly according to claim 1, wherein each ring sector is Pi-shaped in axial section, the first and second tabs extending from the outer face of the annular base forming portion, and wherein the at least one first resilient retention element comprises a base fastened to the ring support structure and from which first and second arms extend, each of the first and second arms including a C-clip type resilient attachment portion at a free end of the first and second arms, a free end of the first tab of each ring sector being retained by the resilient attachment portion of the first arm, while a free end of the second tab of each ring sector is retained by the resilient attachment portion of the second arm of the at least one first resilient retention element.

3. The assembly according to claim 2, wherein the first tab of each ring sector includes an outer groove and an inner groove co-operating with the C-clip type resilient attachment portion of the first arm of the at least one first resilient retention element, and wherein the second tab of each ring sector includes an outer groove and an inner groove co-operating with the C-clip type resilient attachment portion of the second arm of the first resilient retention element.

4. The assembly according to claim 3, wherein the inner and outer grooves of the first and second tabs of each ring sector present a radius of curvature similar to a radius of curvature of the C-clip type resilient attachment portions of the first and second arms of the at least one first resilient retention element.

5. The assembly according to claim 3, wherein the inner and outer grooves of the first and second tabs of each ring sector are rectilinear in shape, and wherein the C-clip type resilient attachment portions of the first and second arms of the at least one first resilient retention element extend along a straight line.

6. The assembly according to claim 1, wherein each ring sector is Pi-shaped in axial section, the first and second tabs extending from the outer face of the annular base forming portion, and wherein the at least one first resilient retention element comprises a base fastened to the ring support structure and from which there extend first and second arms together forming a C-clip type resilient attachment portion, a free end of the first tab of each ring sector being retained by the first arm, while a free end of the second tab of each ring sector is retained by the second arm of the at least one first resilient retention element.

7. The assembly according to claim 6, wherein the first tab of each ring sector includes an outer groove co-operating with a free end of the first arm of the at least one first resilient retention element, and wherein the second tab of each ring sector includes an outer groove co-operating with a free end of the second arm of the at least one first resilient retention element.

8. The assembly according to claim 7, wherein the outer grooves of the first and second tabs of each ring sector are rectilinear in shape, and wherein the free ends of the first and second arms of the at least one first resilient retention element extend along a straight line.

9. The assembly according to claim 1, wherein each ring sector presents a K-shape in axial section, the first and second tabs extending from the outer face of the annular base forming portion, the first tab having an annular groove at a first end opposite the annular base forming portion in which there is received the annular projection of the first annular flange, and wherein the second tab of each ring sector is connected to the second annular flange via the at least one first resilient retention element.

10. The assembly according to claim 9, wherein the second tab of each ring sector is connected to the second annular flange of the ring support structure by at least one clip element formed by the at least one first resilient retention element.

* * * * *